US006401460B1

(12) United States Patent
Xia

(10) Patent No.: US 6,401,460 B1
(45) Date of Patent: Jun. 11, 2002

(54) ACTIVE CONTROL SYSTEM FOR GAS TURBINE BLADE TIP CLEARANCE

(75) Inventor: John Xia, Winter Springs, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 0 days.

(21) Appl. No.: 09/642,464

(22) Filed: Aug. 18, 2000

(51) Int. Cl.[7] ..... F02C 7/12; F02C 7/18; F01D 11/20; F01D 11/24

(52) U.S. Cl. ..... 60/782; 60/806; 415/14; 415/173.2; 415/176

(58) Field of Search ..... 60/39.02, 39.75, 60/806, 782; 415/14, 173.1, 173.2, 176, 178

(56) References Cited

U.S. PATENT DOCUMENTS 4,648,241 A * 3/1987 Putman et al. ..... 60/39.29
4,765,742 A * 8/1988 Davison ..... 356/373
4,804,905 A * 2/1989 Ding et al. ..... 324/61 P
4,928,240 A * 5/1990 Davison et al. ..... 60/39.75
5,005,352 A 4/1991 Schwarz et al.
5,012,420 A * 4/1991 Walker et al. ..... 60/39.75
5,090,193 A 2/1992 Schwarz et al.
5,116,199 A 5/1992 Ciokajlo
5,267,831 A 12/1993 Damiral
5,392,614 A * 2/1995 Coffinberry ..... 62/402
5,593,277 A 1/1997 Proctor et al.
5,605,437 A * 2/1997 Meylan ..... 415/175
5,667,358 A * 9/1997 Gaul ..... 415/173.1
5,791,872 A 8/1998 Owen

* cited by examiner

*Primary Examiner*—Ted Kim

(57) ABSTRACT

A method of actively controlling the clearance between the rotating components and the stationary components of a combustion gas turbine engine includes employing an active control system that controls the temperature of bleed air that is delivered to the stationary and rotating components to control the thermal growth thereof and to avoid a pinch point. The active control system includes one or more sensors and controls the operation of heat sources interposed within the air passages that deliver bleed air to the stationary and rotating components. The heat sources supply heat to the bleed air at specified rates responsive to a correction signal to control the thermal growth of the stationary and rotating components and to control the blade tip

30 Claims, 3 Drawing Sheets

ACTIVE CONTROL SYSTEM FOR GAS TURBINE BLADE TIP CLEARANCE

BACKGROUND OF THE INVENTION

1. Technical Field

The present invention relates generally to combustion gas turbine engines, and more particularly, to an active control system for controlling the blade tip clearance of a combustion gas turbine engine.

2. Description of the Related Art

The efficiency of a combustion gas turbine engine is dependent upon many factors, one of which is the radial clearance between adjacent rotating and non-rotating or stationary components such as between the blade tips and the ring segments that are circumferentially mounted on a blade ring and are disposed adjacent the blade tips. If the clearance is too great, an unacceptable degree of gas leakage will occur with a resultant loss in efficiency. If the clearance is too little, a risk exists that under certain conditions undesirable physical contact will occur between the rotating and stationary components.

Prior to operation of the engine, an initial clearance exists between the rotating and stationary components of the engine. When the engine is initially started, the clearance decreases due to centrifugal forces and thermal growth of the rotating components. In this regard, it is understood that the rotating components initially tend to heat up and thus thermally grow at a faster rate than the stationary components. Nevertheless, inasmuch as the stationary components are circumferentially large, the thermal growth that is eventually experienced by the stationary components is substantially greater than that experienced by the rotating components. As such, during engine startup the blade tip clearance initially decreases until the stationary components heat up and begin to experience their own thermal growth, which has a tendency to increase the blade tip clearance.

It can be seen , therefore, that during engine startup the blade tip clearance decreases from the initial clearance to a minimum clearance, and thereafter increases until the engine reaches steady state operation, after which the engine operates at a constant running clearance. The minimum clearance point is known as the "pinch point" of the engine, meaning that the rotating components are at their closest proximity with the stationary components. Inasmuch as it is desired to avoid physical contact between the rotating and stationary components, engines must be designed around the pinch point to ensure that no such contact occurs during operation of the engine.

While different types of control systems have been proposed in an attempt to alleviate the running clearance that occurs during steady state operation of the engine, a need nevertheless exists for an active control system that avoids the pinch point of the engine to thereby improve performance. Additionally, known control systems typically employ adjustable flow impediments which adjust the rate at which bleed air is delivered to certain components of the engine. Such variability in the rates of bleed air flow has a detrimental effect on engine efficiency. A need thus exists for an active control system that controls the temperatures of engine components without adjusting the flow rates at which bleed air is delivered to the components. Additionally, no such control system has employed a sensor that continuously monitors the blade tip clearance and allows for corrective signals to maintain the engine at a desired tip clearance and efficiency. A need thus exists for an active control system that performs such continuous monitoring and allows for such continuous correction.

SUMMARY OF THE INVENTION

A method of actively controlling the clearance between the rotating components and the stationary components of a combustion gas turbine engine includes employing a control system that controls the temperature of bleed air that is delivered to the stationary and rotating components to control the thermal growth thereof and to avoid a pinch point. The control system includes one or more sensors that are circumferentially distributed about the engine and measure the blade tip clearance. The clearance measurements are directed to a controller that generates a correction signal corresponding with a desired clearance setting. The correction signal controls the operation of heat sources interposed within the air passages that deliver bleed air to the stationary and rotating components. The heat sources supply heat to the bleed air at specified rates responsive to the correction signal to control the thermal growth of the stationary and rotating components and to control the blade tip clearance. The use of multiple sensors permits the system of the present invention to alleviate the negative effects of "ovalization" of the stationary components that often occurs with use of the engine due to plastic deformation and that results in the stationary components creeping from a circular configuration to a non-circular or oval-shaped configuration.

BRIEF DESCRIPTION OF THE DRAWINGS

The preferred embodiment of the invention, illustrative of the best mode in which Applicant has contemplated applying the principles of the invention, is set forth in the following description and is shown in the drawings and is particularly and distinctly pointed out and set forth in the appended claims.

Similar numerals refer to similar parts throughout the specification.

DESCRIPTION OF THE PREFERRED EMBODIMENT

Figure 1:
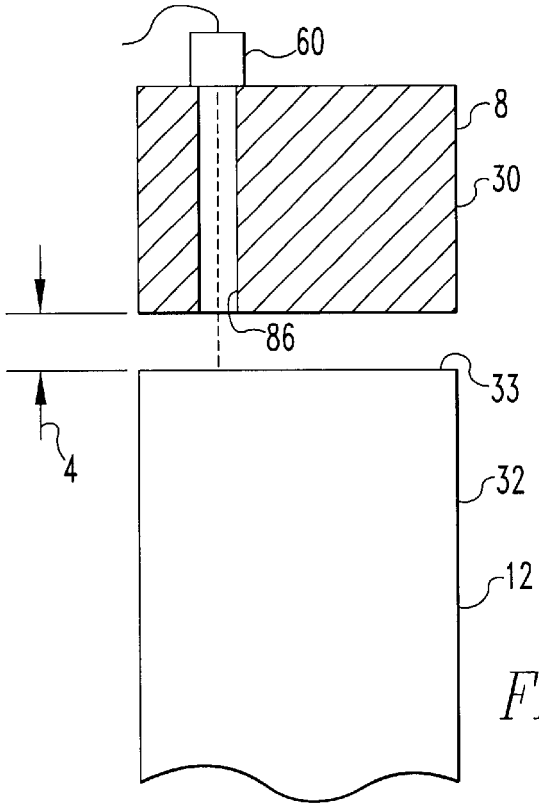
FIG. 1 is a schematic view of a portion of a combustion gas turbine engine depicting a clearance at one circumferential location between a stationary component and a rotating component of the engine.
Figure 2:
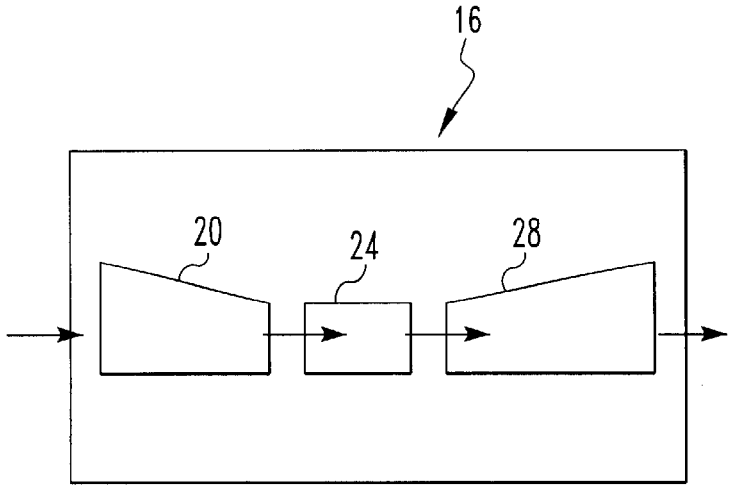
FIG. 2 is a schematic view of a combustion gas turbine engine to which the method of the present invention can be applied.

As is depicted schematically in FIGS. 1 and 2, the method and apparatus of the present invention are employed to actively control a clearance 4 between a stationary component 8 and a rotating component 12 of a combustion gas turbine engine 16. The combustion gas turbine engine 16 includes a compressor section 20, a combustor section 24, and a turbine section 28 through which large quantities of air serially flow, as is depicted generally by the arrows in FIG. 2.

With continued reference to FIG. 1, it is understood that the rotating component 12 refers generally to a blade 32 mounted on and extending radially outward from a rotating shaft in a compressor or turbine stage in either of the compressor and turbine sections 20 and 28 of the engine 16. Each blade 32 terminates at a tip 33, which is the radially outermost portion of the blade 32. The engine thus includes a plurality of rotating components 12 as defined herein.

It is further understood that the stationary component 8 generally includes a portion of a stationary blade ring to which are mounted a plurality of stationary vanes that extend radially inward from the blade ring, as well as a portion of a ring segment 30 mounted on the blade ring. As is known in the relevant art, a plurality of ring segments 30 are circumferentially mounted along the blade ring and are disposed adjacent the tips 33 of the blades 32. It is thus understood that the engine 16 includes a plurality of stationary components 8.

It can thus be seen that the clearance 4 depicted in FIG. 1 between the stationary component 8 and the rotating component 12 are illustrated as being a clearance 4 between a ring segment 30 and a tip 33 of a blade 32. It is therefore understood that the clearance 4 depicted in FIG. 1 is only a small circumferential portion of the entire circumferential clearance between a plurality of commonly mounted rotating components 12 and a plurality of commonly mounted stationary components 8.

Figure 3:
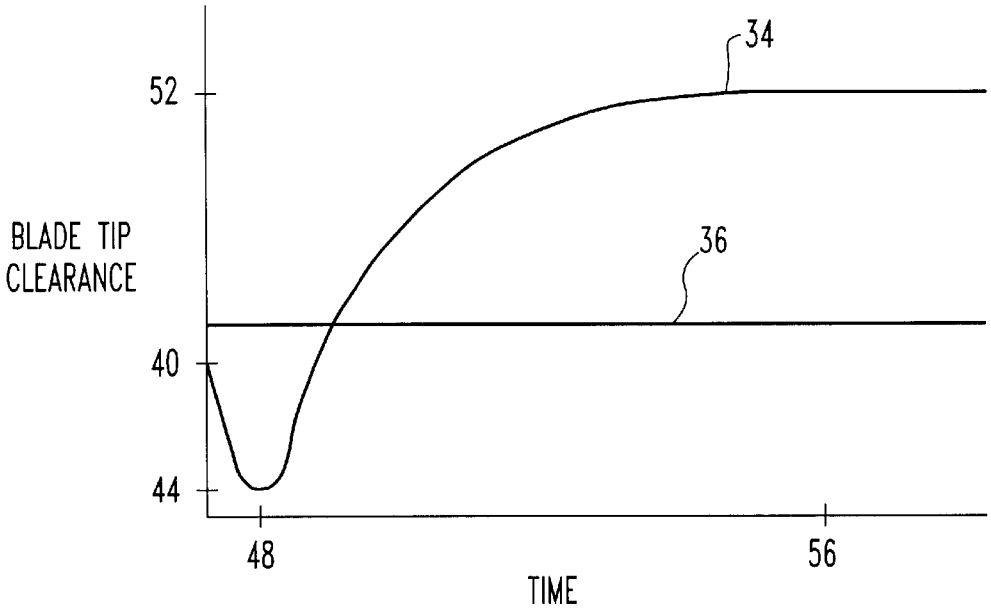
FIG. 3 is a graph depicting generally the blade tip clearance of a combustion gas turbine engine from initial startup through steady state operation, and shows separate curves depicting results obtained with the active control system of the present invention as well as without such control.

As is understood in the relevant art, the clearance 4 can vary from the time the engine 16 is initially started until the time the engine 16 reaches steady state operation. Such variation in the clearance 4 depends upon the thermal growth of the stationary and rotating components 8 and 12, as well as the centrifugal forces acting upon the rotating components 12. FIG. 3 is a graph that charts generally the blade tip clearance 4 for the engine 16 as a function of time from startup through steady state operation. FIG. 3 includes a first curve 34 that shows the clearance 4 of the engine 16 in the absence of the active control system of the present invention, as well as a second curve 36 that shows the clearance 4 that is achieved when the active control system of the present invention is applied to the engine 16 during operation thereof.

With continued attention to FIG. 3, it can be seen that the first curve 34 begins with the clearance 4 being at an initial clearance 40 prior to the engine 16 being started. The initial clearance 40 can vary depending upon whether the engine 16 is being started at a "cold start" or at a "hot start." A cold start typically refers to a startup from a condition in which the stationary and rotating components 8 and 12 of the engine 16 are both at the same relatively cold temperature. A hot start refers to a startup from a condition in which the engine 16 is restarted after being shut down only for a relatively small period of time, whereby the stationary components 8 have cooled to a relatively greater extent than the rotating components 12. Such differential cooling results from god the fact that the rotating components 12, including the blade disks on which the blades 32 are mounted, are relatively more massive than the stationary components 8, and thus cool more slowly. Such differential cooling also from the rotating components 12 being disposed generally internal to the stationary components 8, such that the stationary components 8 will have a tendency to cool prior to the internal rotating components 12.

Regardless of whether the initial clearance 40 results from a cold or hot starting condition, the clearance 4 decreases from the moment the engine 16 is started until the clearance 4 reaches a minimum 44. The minimum clearance 44 is referred to as a pinch point 48 of the engine 16.

The pinch point 48 results primarily from the relatively rapid thermal expansion of the blades 32 of the rotating components 12 and the centrifugal elongation of the blades 32, during which the stationary components 8 achieve relatively minor expansion. As such, the clearance 4 decreases until the pinch point 48 is reached. Once the thermal expansion of the stationary components 8 begins to outpace the expansion of the rotating components 12, however, the clearance 4 between the stationary and rotating components 8 and 12 begin to increase and the pinch point 48 is passed.

The clearance 4 thereafter continues to increase until the engine 16 achieves steady state operation 56, at which point the clearance 4 is at a running clearance 52 which is maintained until the engine 16 is shut down. While the running clearance 52 is depicted in FIG. 3 as being greater than the initial clearance 40, the relative clearances depicted in the first curve 34 are presented merely for the purposes of illustration. It can be seen from the first curve 34, however, that the clearance 4 varies greatly during the startup of the engine 16 and remains at a relatively high level once the engine 16 has achieved steady state operation 56.

In contrast to the first curve 34, the second curve 36 generally depicts the clearance 4 that results from applying the active control system and method of the present invention to the engine 16 from startup through steady state operation. In this regard, it is understood that the actual circumstances of operation of the engine 16 will approximate the second curve 36. As will be set forth more fully below, the apparatus and method of the present invention permit the clearance 4 to be maintained at a substantially constant level and thus advantageously permits the engine 16 to avoid the pinch point 48 during startup.

Figure 4:
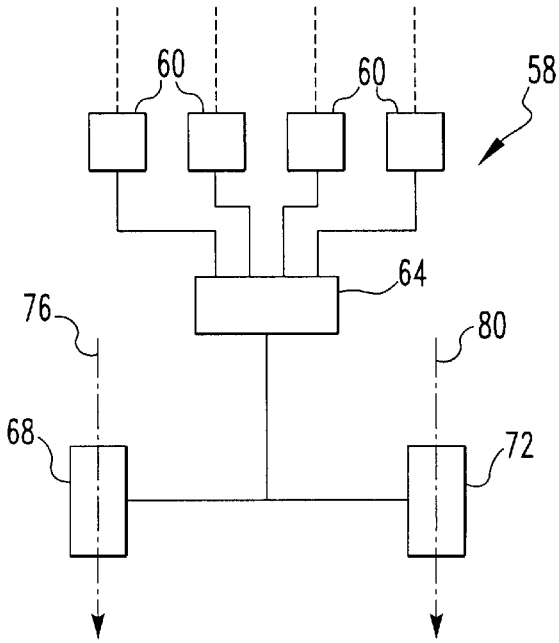
FIG. 4 is a schematic representation of an active control system in accordance with the present invention that is employed to practice the method of the present invention.

As is best shown in FIG. 4, the method of the present invention is practiced by employing an active control system 58 in conjunction with startup and operation of the engine 16. The active control system 58 includes a plurality of sensors 60, a controller 64, a first heat source 68, and a second heat source 72 that are operatively connected with one another. While the active control system 58 is depicted in the present embodiment as including four of the sensors 60, it will be apparent that a greater or lesser number of the sensors 60 can be employed with the active control system 58 depending upon the specific needs of the particular application.

The sensors 60 are electronic components that measure the clearance 4 at a given circumferential location on the engine 16. The sensors 60 are preferably of a type that emits a beam (shown in FIGS. 1 and 4) such as a laser beam or other electromagnetic beam, although other types of sensors may be employed in the active control system 58 of the present invention. One example of a sensor 60 that may be employed in the active control system 58 is known as a "BICC Probe" that is obtainable from BICC General Pyrotenax Cables Ltd. of the United Kingdom, although other sensors 60 may be employed without departing from the present invention.

It can be seen from FIG. 1 that the sensor 60 is schematically depicted as being mounted on the ring segment 30 such that the beam emanating from the sensor 60 is directed through a channel 86 formed in the ring segment 30 and toward the tip 33 of the blade 32. It is understood in this regard that numerous different mounting methodologies may be employed for operatively mounting the sensors on the engine 16 without affecting the concept of the present invention.

Figure 5:
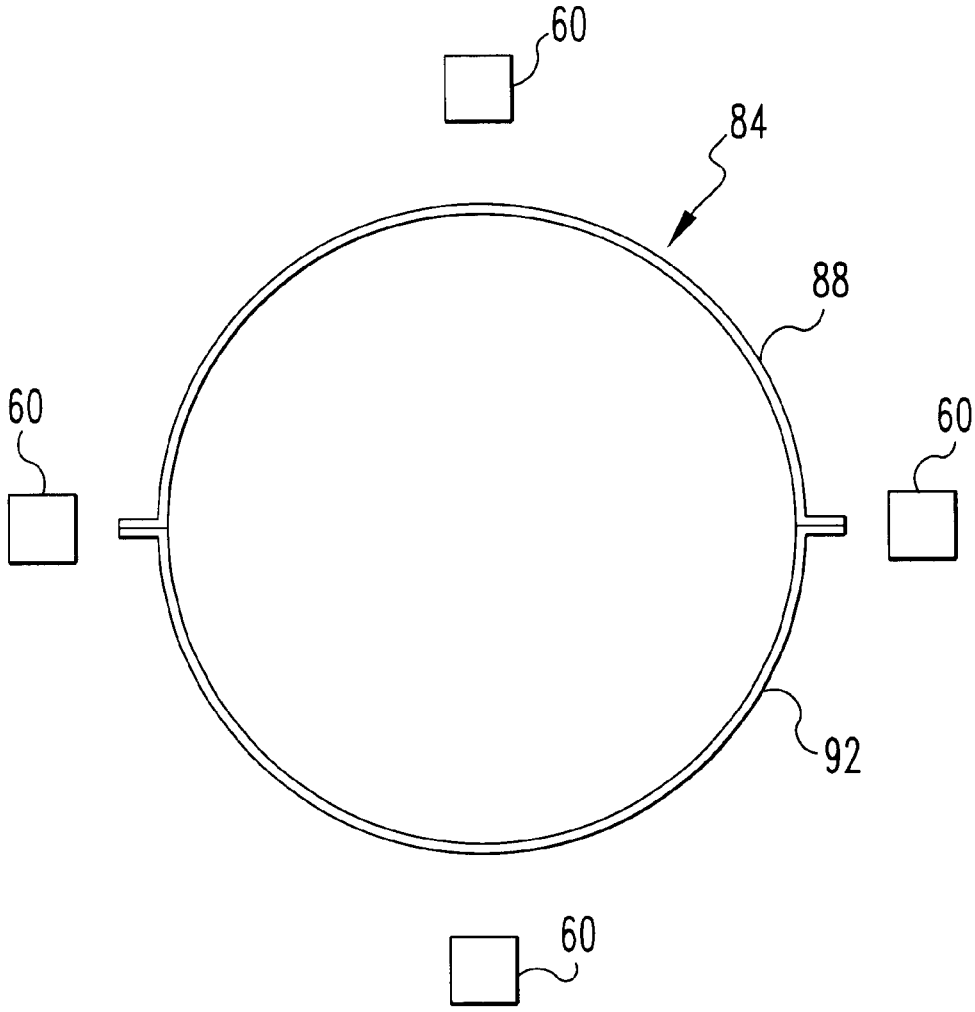
FIG. 5 is a schematic end view of a stationary component in a combustion gas turbine engine.

With particular attention to FIG. 5, the stationary components 8 are depicted herein as including a blade ring 84 having an upper portion 88 and a lower portion 92. In the embodiment shown herein, the upper and lower portions 88 and 92 are semi-annular members that connect with one another along a horizontal plane to form the substantially cylindrical blade ring 84, with the blade ring 84 being supported in the horizontal plane.

As is known in the relevant art, the stationary components 8 of the engine 16 can experience "ovalization," an example of which would include a change in the cross section of the blade ring 84 from substantially circular to non-circular or oval-shaped as a result of material creep due to a number of factors. If, for instance, the blade ring 84 is supported solely at its horizontally outermost regions, as is generally depicted herein, the ovalization likely will manifest itself to the greatest extent in the horizontal and vertical planes. More specifically, the effect of such ovalization is experienced to the greatest extent in a first plane common with the points at which the blade ring 84 is supported, as well as in a second plane that is perpendicular with the first plane. It is understood in this regard that blade rings that are supported in multiple planes are expected to experience correspondingly complicated ovalization characteristics.

Any such ovalization may result in the clearance 4 between the stationary and rotating components 8 and 12 being either decreased or increased depending upon the nature of the ovalization. For instance, ovalization of the blade ring 84 depicted in FIG. 5 might result in the clearance 4 being reduced in the vertical plane and increased in the horizontal plane. Inasmuch as it is desired to avoid physical contact between the stationary and rotating components 8 and 12, the clearance 4 at its circumferential minimum must be known. As is shown diagrammatically in FIG. 5, therefore, the preferred positioning of the four sensors 60 is at horizontally and vertically opposed positions equally distributed about the circumference of the blade ring 84.

It can be seen that a greater or lesser number of sensors 60 may be appropriate depending upon the configuration of the engine 16. In practice, however, it has been determined that four of the sensors 60 appears to be the minimum number that can successfully alleviate the likelihood of physical contact between the stationary and rotating components 8 and 12.

Once each of the sensors 60 has measured the clearance 4 at the various circumferential locations, the sensors 60 each generate an output indicative of the measurement. The outputs are electronically delivered to the controller 64 which determines the smallest or least of the measurements and deems this smallest or least measurement to be the clearance 4 that will be used in controlling the engine 16. The controller 64 than compares this measured minimum clearance 4 with a desired setting to be achieved for the clearance 4 to generate a correction signal. The correction signal is indicative of the thermal change that the stationary and/or rotating components 8 and 12 are desired to undergo to achieve the desired setting of the clearance 4.

As in known in the relevant art, the engine 16 includes a plurality of internal and/or external air channels that deliver bleed air from various stages of the compressor section 20 to the stationary and rotating components 8 and 12. Such bleed air is generally available to provide a beneficial cooling effect to the stationary and rotating components 8 and 12. Such bleed air flow is depicted schematically by the arrows 76 and 80 that travel past the first and second heat sources 68 and 72, respectively.

The first air flow 76 directs bleed air to the stationary components 8. The second air flow 8 directs bleed air to the rotating components 12. The first and second heat sources 68 and 72 are interposed within the first and second air flows 76 and 80 and are controlled by the controller 64 to deliver heat at a given rate into the first and second air flows 76 and 80 responsive to the correction signal. The rate at which the heat is added to the first and second air flows 76 and 80 can be anywhere from zero to a maximum that the appropriate to the engine 16.

In this regard, it is understood that the function of "cooling" refers to delivering bleed air at a given temperature to an internal component of the engine 16 that is at a relatively higher temperature. As such, the present invention is not depicted as involving the active cooling of bleed air, but rather involves the delivery of bleed air that is at a temperature lower than that of the component to which the bleed air is delivered. It is thus understood that the cooling function can refer to the delivery of bleed air that is unheated by the first or second heat sources 68 or 72 or is heated by the first or second heat sources 68 or 72 to a temperature that is nevertheless lower than that of the component to which the bleed air is delivered.

When it is desired to increase the thermal growth of the stationary components 8, for instance, the first heat source 68 delivers heat at a rate determined by the controller 64 into the first air flow 76 to raise the temperature thereof. When it is desired to reduce the thermal growth of the stationary components 8, the rate at which heat is added to the first air flow 76 is either reduced or set to zero to reduce the temperature of the bleed air in the first air flow 76 and to thermally shrink the stationary components 8. The same can be said of the rotating components 12, the thermal growth of which are controlled by the second heat source 72 which interposed within the second air flow 80.

As such, when it is desired to reduce the clearance 4, the stationary components 8 can be cooled and/or the rotating components 12 can be heated in the aforementioned fashion. Such differential cooling and heating would have the effect of thermally moving the stationary components 8 and the rotating components 12 toward one another, with the effect that the clearance 4 is reduced. The clearance 4 can be increased in the opposite alternate fashion.

In order to beneficially avoid the pinch point 48 for the reasons set forth above, it is desired to heat the stationary components 8 and cool the rotating components 12 prior to the engine 16 temporally reaching the pinch point 48. Such heating and cooling will have the effect of increasing the clearance 4 and thus counteracting the reduction in the clearance 4 that otherwise would occur as depicted generally by the first curve 34 in FIG. 3. Prior to reaching the pinch point 48, therefore, heat is added to the first air flow 76 at a first initial rate, and is simultaneously added to the second air flow 80 at a second initial rate.

Subsequent to reaching the pinch point 48, the cooling and heating efforts are reversed to counteract the increase in the clearance 4 that otherwise would occur without the use of the active control system 58. More specifically, after the pinch point 48 is reached, the first heat source 68 reduces the rate at which it adds heat to the first air flow 76 going to the stationary components 8, and the second heat source 72 increases the rate at which it adds heat to the second air flow 80 going to the rotating components 12, with the aforementioned changes in heating rates being responsive to the correction signal that is generated by the controller 64.

As such, subsequent to the pinch point 48 heat is added to the first air flow 76 at a first subsequent rate, and is simultaneously added to the second air flow 80 at a second subsequent rate. In alternately heating and cooling the stationary and rotating components 8 and 12 on alternate sides of the pinch point, it can therefore be seen generally that the first initial rate is greater than the first subsequent rate, and that the second initial rate is less than the second subsequent rate.

By alternately counteracting the typical decrease in the clearance 4 and the subsequent increase therein, the relatively flat and horizontal second curve 36 can be achieved for the clearance 4. In this regard, it is understood that desired clearance 4 achieved for the engine 16 and depicted by the second curve 36 can be increased or decreased depending upon the condition and configuration of the engine 16, as well as the needs of the particular application.

In avoiding the pinch point 48 with the active control system 58 of the present invention, however, it is desirable for the active control system 58 to operate in accordance with whether the temporal condition of the engine 16 is prior to or subsequent to the pinch point 48. In this regard, the controller 64 compares progressive measurements of the clearance 4 to determine generally whether the clearance 4 is increasing or decreasing. If the clearance 4 is on a path whereby it progressively decreases, the engine 16 is operating prior to reaching the pinch point 48. If the clearance 4 is increasing, the engine 16 is operating past the pinch point 48. Such a recognition of the temporal condition of the engine 16 with respect to the pinch point 48 enhances the efficiency and the speed with which corrections in the clearance 4 can be made by the active control system 58.

More specifically, the comparison by the controller 64 of progressive clearance values 4 generates a change characteristic that is indicative of an operating condition of the engine 16. In the embodiment described herein, the operating condition of the engine 16 is the temporal condition of the engine 16 with respect to the pinch point 48, although it is understood that the present invention may have other applications in the engine 16. The change characteristic will have a first indicium if the clearance 4 is decreasing, such as when the engine 16 is operating prior to the pinch point 48. The change characteristic will have a second indicium when the clearance 4 is increasing, such as when the engine 16 is operating subsequent to reaching the pinch point 48.

In this regard, it is understood that the first and second indicia are suited to the operating characteristics of the active control system 58. As a first example, if the active control system 58 is an analog system, the first and second indicia may be of negative and positive values, respectively. As a second example, if the active control system 58 is a digital system, the first and second indicia may be zero and one values, respectively, or other values. It can thus be seen that the first and second indicia can be of virtually any quality appropriate to the active control system 58.

In this regard, inasmuch as the clearance 4 can be altered by adjusting the temperature of either of the first and second air flows 76 and 80, it is desired for the active control system 58 to generate a correction signal based upon whether the engine 16 is operating prior to or subsequent to the pinch point 48. The correction signal will be tailored to adjust the temperatures of either or both of the first and second air flows 76 and 80 to an appropriate extent based upon performance needs and the operating condition of the engine 16, which in the present embodiment is the temporal condition of the engine 16 with respect to the pinch point 48.

The configuration of the active control system 58 of the present invention and the method thereof achieve their goals by adding heat at appropriate rates to the bleed air of the first and second air flows 76 and 80, with the first and second air flows 76 and 80 each remaining at substantially constant flow rates. By varying the temperatures of the first and second air flows 76 and 80 instead of altering the flow rates thereof, the efficiency of the engine is unaffected by varying flow rates and can be controlled merely by interposing the first and second heat sources 68 and 72 into the first and second air flows 76 and 80, respectively.

It is appreciated that the first and second heat sources 68 and 72 can be of numerous configurations. For instance, the first and second heat sources 68 and 72 can be electrically operated. Alternatively, the first and second heat sources 68 and 72 can be heat exchangers that derive heat from the high temperature exhaust gases within or exiting the turbine section 28 once such exhaust gases have reached a given temperature, which is usually subsequent to initial startup. Still alternatively the first and second heat sources 68 and 72 can derive their heat from other known sources.

It is also understood that the teachings of the present invention can be applied to other types of machinery other than the combustion gas turbine engine 16. For instance, the teachings can be applied to a machine such as a steam turbine which has both stationary and rotating components in close proximity with one another. The present invention can also be applied to other machinery.

The active control system 58 of the present invention thus advantageously controls the clearance 4 between the stationary and rotating components 8 and 12 of the engine 16 in such a fashion to improve the efficiency thereof and avoid the pinch point 48. The active control system 58 additionally alleviates the effects of ovalization, and furthermore does not rely upon altering the rates at which bleed air flows to the stationary and rotating components 8 and 12, which avoids an otherwise deleterious effect on the efficiency of the engine 16.

While a particular embodiment of the present invention has been described herein, it is understood that various changes, additions, modifications, and adaptations may be made without departing from the scope of the present invention, as set forth in the following claims.

I claim:

1. A method of actively controlling a clearance between a first component and a second component of a combustion gas turbine engine during operation of the engine, the method comprising the steps of:

taking a first measurement of the clearance with a sensor mechanism;

comparing the first measurement with a desired setting;

generating a correction signal with a controller;

supplying a first air flow to the first component, said first component having a first radial location;

controlling the temperature of the first air flow responsive to the correction signal;

supplying a second air flow to the second component, said second component having a second radial location, said clearance being located radially between said first and second components; and controlling the temperature of the second air flow responsive to the correction signal;

whereby, said clearance is maintained by cooperative control of thermal growth of said first and second components.

2. The method as set forth in claim 1, further comprising the steps of generating a change characteristic indicative of an operating condition of the engine, and employing the change characteristic to generate the correction signal.

3. The method as set forth in claim 2, in which the step of supplying a first air flow to the first component includes the step of supplying the first air flow to a stationary component, and in which the step of supplying a second air flow to the second component includes the step of supplying the second air flow to a rotating component.

4. The method as set forth in claim 3, in which the step of generating a change characteristic includes the step of generating a change characteristic that is based upon a temporal condition of the engine with respect to a pinch point of the engine.

5. The method as set forth in claim 4, in which the step of generating a change characteristic includes the steps of taking a second measurement of the clearance with the sensor mechanism and comparing the second measurement with the first measurement.

6. The method as set forth in claim 5, in which the step of generating a change characteristic includes the step of generating a change characteristic having a first indicium when the engine is operating prior to reaching the pinch point.

7. The method as set forth in claim 6, in which the step of controlling the temperature of the first air flow includes the step of adding heat at a first heating rate from a first heat source to the first air flow when the change characteristic has the first indicium.

8. The method as set forth in claim 7, in which the step of adding heat at a first heating rate from a first heat source includes the step of adding heat from a heat exchanger.

9. The method as set forth in claim 7, in which the step of generating a change characteristic includes the step of generating a change characteristic having a second indicium when the engine is operating subsequent to reaching the pinch point.

10. The method as set forth in claim 9, in which the step of controlling the temperature of the second air flow includes the step of adding heat at a second heating rate from a second heat source to the second air flow when the change characteristic has the second indicium.

11. The method as set forth in claim 1, in which the step of taking a first measurement of the clearance with a sensor mechanism includes the steps of measuring the clearance at a plurality of circumferential locations on the engine with a sensor at each location, determining the lesser of the measured clearances from the sensors, and employing the lesser of the measured clearances as the first measurement of the clearance.

12. The method as set forth in claim 11, in which the step of taking a first measurement of the clearance with a sensor mechanism further includes the steps of measuring the clearance at a second circumferential location on the engine with a second sensor and determining the lesser of the measured clearances from the first and second sensors.

13. The method as set forth in claim 12, in which the step of determining the lesser of the measured clearances from the first and second sensors includes the step of employing the lesser of the measured clearances as the first measurement of the clearance.

14. The method as set forth in claim 1, in which the step of controlling the temperature of the first air flow responsive to the correction signal includes the steps of adding heat to the first air flow at a first initial rate before the engine reaches a pinch point during engine startup and adding heat to the first air flow at a first subsequent rate after the engine reaches the pinch point, the first initial rate being greater than the first subsequent rate.

15. The method as set forth in claim 14, in which the step of controlling the temperature of the second air flow responsive to the correction signal includes the steps of adding heat to the second air flow at a second initial rate before the engine reaches the pinch point and adding heat to the second air flow at a second subsequent rate after the engine reaches the pinch point, the second initial rate being less than the second subsequent rate.

16. The method as set forth in claim 1, in which the step of controlling the temperature of the first air flow responsive to the correction signal includes the step of maintaining the rate of the first air flow substantially unvarying at a given speed of the engine.

17. An active control system for controlling a clearance radially between a first component and a second component of a combustion gas turbine engine during operation of the engine, the active control system comprising:

a sensor mechanism for measuring the clearance between the first and second components and providing an output signal indicative thereof;

a controller operatively connected with the sensor mechanism, the controller being structured to receive the output signal from the sensor mechanism and generate a correction signal in response thereto;

a first heat source operatively connected with the controller, the first heat source being structured to supply heat at a first heating rate responsive to the correction signal to a first air flow for controlling the temperature of the first component, said first air flow being fluidly connected to said first component; and a second heat source operatively connected with the controller, the second heat source being structured to supply heat at a second heating rate responsive to the correction signal to a second air flow for controlling the temperature of the second component, said second air flow being fluidly connected to said second component;

whereby, said clearance is maintained by cooperative control of thermal growth of said first and second components.

18. The active control system as set forth in claim 17, in which the sensor mechanism includes a plurality of sensors.

19. The active control system as set forth in claim 18, in which each of the plurality of sensors includes a laser.

20. The active control system as set forth in claim 17, in which at least one of the first and second heat sources is a heat exchanger.

21. The active control system as set forth in claim 17, in which the active control system is structured to operate in an environment in which the first component is a stationary component, and in which the second component is a rotating component.

22. A combustion gas turbine engine comprising:

a compressor section;

a combustor section;

a turbine section;

at least one of the compressor and turbine sections including a first component having a first radial location and a second component having a second radial location;

an active control system for controlling a clearance located radially between the first and second components during operation of the engine;

the active control system including a sensor mechanism for measuring the clearance and providing an output signal indicative thereof, a controller, a first heat source, and a second heat source;

the controller being operatively connected with the sensor mechanism and being structured to receive the output signal from the sensor mechanism and generate a correction signal in response thereto;

the first heat source being operatively connected with the controller and being structured to supply heat at a first heating rate responsive to the correction signal to a first air flow to the first component for controlling the temperature of the first component, said first air flow being fluidly connected to said first component; and the second heat source being operatively connected with the controller and being structured to supply heat at a second heating rate responsive to the correction signal to a second air flow to the second component for controlling the temperature of the second component, said second air flow being fluidly connected to said second component;

whereby, said clearance is maintained by cooperative control of thermal growth of said first and second components.

23. The combustion gas turbine engine as set forth in claim 22, in which the first component is a stationary component, and in which the second component is a rotating component.

24. The combustion gas turbine engine as set forth in claim 22, in which the sensor mechanism includes a plurality of sensors.

25. The combustion gas turbine engine as set forth in claim 24, in which the plurality of sensors are circumferentially distributed about the engine.

26. The combustion gas turbine engine as set forth in claim 25, in which the engine in supported in at least a first plane, and in which a second plane is perpendicular to the first plane, the sensors being in the at least first and second planes.

27. The combustion gas turbine engine as set forth in claim 25, in which the sensors are in vertically and horizontally opposed circumferential positions.

28. The combustion gas turbine engine as set forth in claim 25, in which each of the plurality of sensors includes a laser.

29. The combustion gas turbine engine as set forth in claim 22, in which at least one of the first and second heat sources is a heat exchanger.

30. A method of actively controlling a clearance located radially between a stationary component and a rotating component of a machine during operation of the machine, the method comprising the steps of:

taking a first measurement of the clearance with a sensor mechanism;

comparing the first measurement with a desired setting;

generating a correction signal with a controller;

supplying a first air flow to the stationary component;

controlling the temperature of the first air flow responsive to the correction signal;

supplying a second air flow to the rotating component; and controlling the temperature of the second air flow responsive to the correction signal;

whereby, said clearance is maintained by cooperative control of thermal growth of said first and second components.

* * * * *